United States Patent [19]

Forschner

[11] Patent Number: 4,995,514

[45] Date of Patent: Feb. 26, 1991

[54] METHOD AND MEASUREMENT SYSTEM FOR THE PRODUCTION OF GARMENT KITS

[76] Inventor: Horst Forschner, Scheffelstrasse 4, D-8011 Kircheim, Fed. Rep. of Germany

[21] Appl. No.: 337,357

[22] Filed: Apr. 13, 1989

Related U.S. Application Data

[63] Continuation-in-part of Ser. No. 115,007, Oct. 28, 1987, Pat. No. 4,860,900.

[51] Int. Cl.[5] ..... A41H 3/08; B65D 85/00

[52] U.S. Cl. ..... 206/574; 2/243 B; 33/12; 33/17 R

[58] Field of Search ..... 2/243 B, 243 R; 33/12–16, 17 A, 17 R; 206/574, 575

[56] References Cited

U.S. PATENT DOCUMENTS

| | | | |
|---|---|---|---|
| 1,616,080 | 2/1927 | Freedman | 33/17 R |
| 1,934,282 | 11/1933 | Telzerow | 2/243 B |
| 2,576,434 | 7/1956 | Rick et al. | 2/243 R |
| 2,636,181 | 4/1953 | Becker | 2/243 B |
| 2,892,196 | 6/1959 | Pundyk et al. | 2/243 R |
| 2,922,167 | 1/1960 | Berlin | 2/243 R |
| 3,177,867 | 4/1965 | Hart | 33/12 |
| 3,523,304 | 8/1970 | Nobles | 33/12 |
| 4,060,436 | 11/1977 | Carlin | 2/243 B |

FOREIGN PATENT DOCUMENTS

| | | | |
|---|---|---|---|
| 0262700 | 4/1988 | European Pat. Off. . | |
| 0262700A3 | 4/1988 | European Pat. Off. . | |
| 2719157 | 11/1978 | Fed. Rep. of Germany | 33/12 |
| 2307484 | 11/1976 | France | 2/243 B |
| 2399810 | 4/1979 | France | 2/243 B |
| 0024772 | of 1895 | United Kingdom | 33/12 |
| 1389405 | 4/1975 | United Kingdom | 33/12 |
| 2098458 | 11/1982 | United Kingdom | 2/243 R |

OTHER PUBLICATIONS

"Stylecraft Sew-Easy", Style Craft, Adv., Washington Evening Star (newspaper), 6/17/52.

"Vogue Fitting", Harper & Row, Publishers, New York, pp. 31, 166 and 167.

"How to Make Men's Clothes", Doubleday & Company, Inc., Garden City, N.Y., 1975, pp. 122 and 124–125.

"The New Vogue Sewing Book", Butterick Publishing, pp. 75 and 477.

"Tailoring: Traditional and Contemporary Techniques", Reston Publishing Company, Inc., Reston, Va., pp. 33–35.

*Primary Examiner*—Jimmy G. Foster

[57] ABSTRACT

A garment kit and method of assembly thereof for sale to a consumer-wearer, for the self assembly of a garment by the consumer-wearer, said kit including a partially prefabricated garment comprising a precut fabric dimensioned to cover a plurality of sizes; said precut fabric being provided with attachment markings thereon corresponding to said plurality of sizes; and said precut fabric already being provided with at least one substantially finished detail. Additionally, a measurement system for the production of both garment kits and fully fabricated garments, wherein a range of sizes, each of which is determined by a plurality of measurements, is divided into subranges, with one of the measurements being maintained substantially constant over the sizes of a subrange. Preferably the subranges overlap.

20 Claims, 9 Drawing Sheets

25

25

25
26

5
24
25
8

23

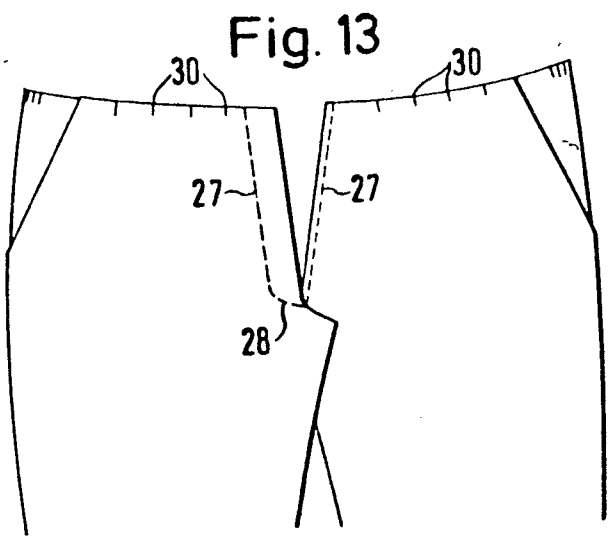
Fig. 13
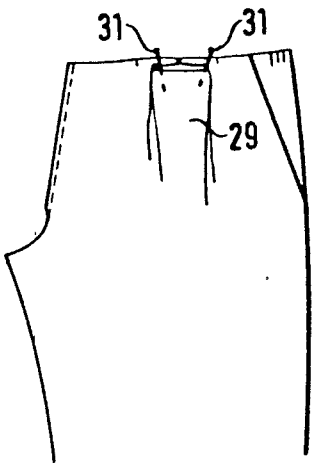
Fig. 14
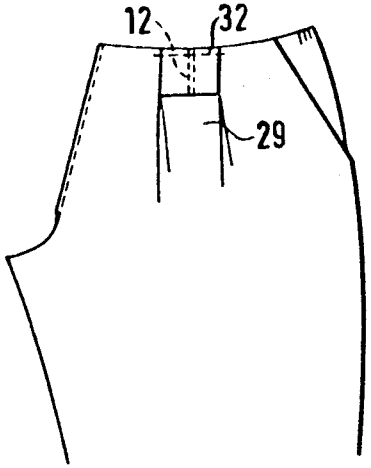
Fig. 15
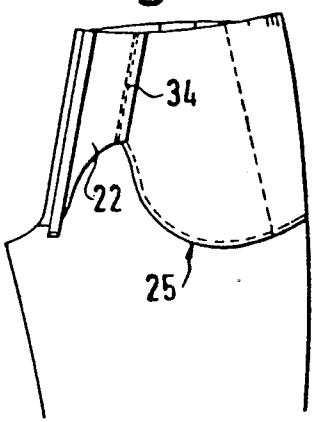
Fig. 17
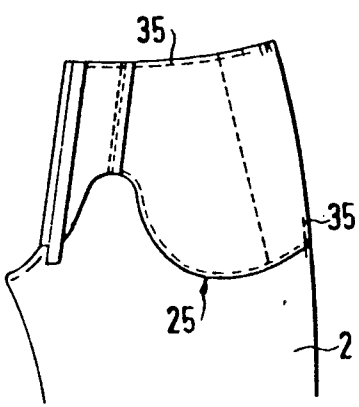
Fig. 18
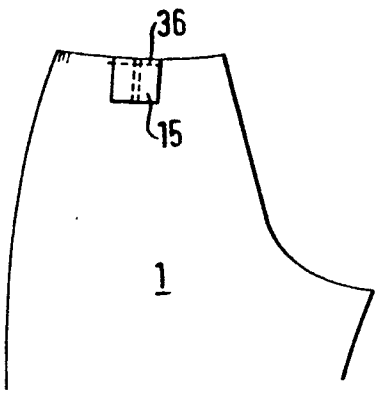
Fig. 16
Fig. 19

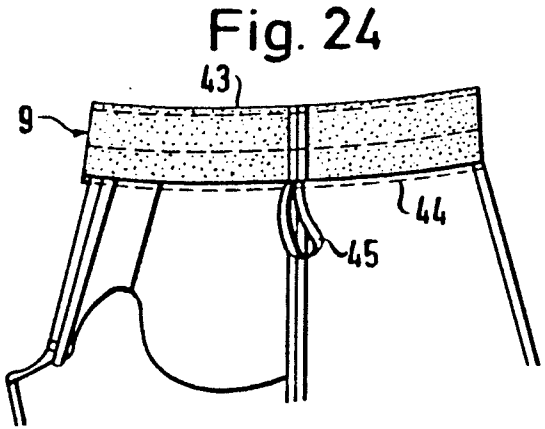
Fig. 24
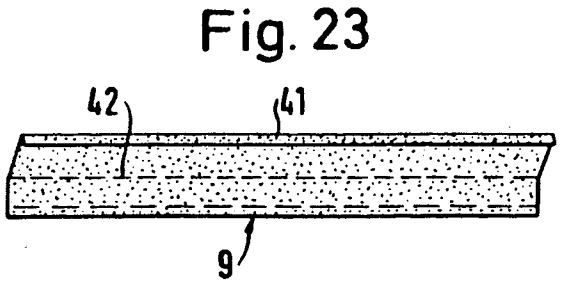
Fig. 23
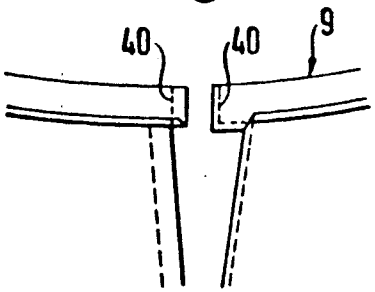
Fig. 22
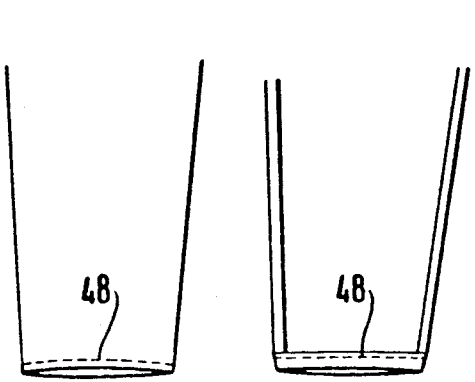
Fig. 28
Fig. 27
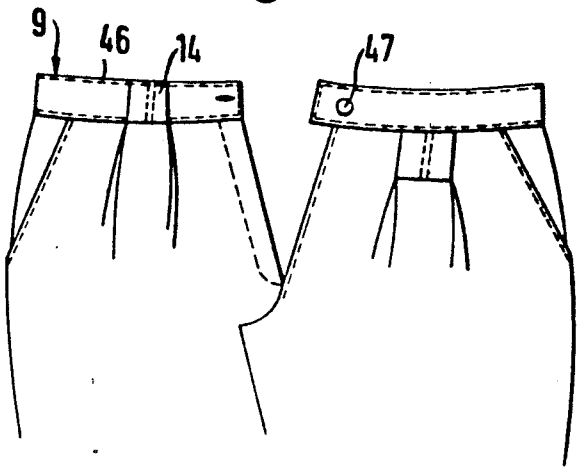
Fig. 26
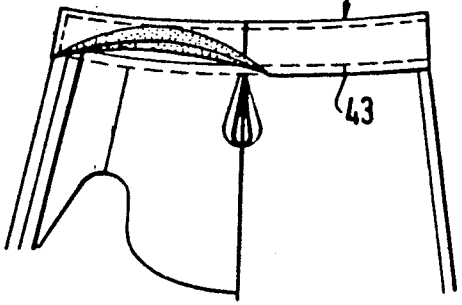
Fig. 25

METHOD AND MEASUREMENT SYSTEM FOR THE PRODUCTION OF GARMENT KITS

BACKGROUND OF THE INVENTION

CROSS-REFERENCE TO RELATED APPLICATIONS

The present application is a continuation-in-part of U.S. patent application Ser. No. 07/115,007, entitled "GARMENT KIT AND METHOD OF ASSEMBLY THEREOF" and filed Oct. 28, 1987 now Pat. No. 4,860,900.

FIELD OF THE INVENTION

In one aspect, the present invention relates to a variable size system (covering at least three sizes) for the self assembly of clothing of all types, e.g., for ladies, men and children.

The invention is directed, in another aspect, to a component kit for the self assembly of such a garment by the consumer. Furthermore, the invention provides a method for self assembly of garments following a specifically defined product-specific sequence of steps in the preliminary production.

DESCRIPTION OF THE PRIOR ART

One method of making garments of any type and form is the industrial full production from the sketch via the cut and the following cutting to size and including the complete ready-to-wear making and subsequent pressing. In this case, the consumer only has to make his choice, from a catalog or in a retail outlet, of the articles disposed or pictured therein, but does not himself have to carry out any work on the garment. For this he must pay a substantially higher price than when making his own clothes.

Furthermore, sewing by the consumer of garments of all types by the principle of a cut pattern, cutting to size, obtaining all the accessories and individual production, is known.

The consumer is first compelled to select, in several individual actions, the cut of the garment he prefers, the material or the knitwear, the lining, the yarn and the particular fastener elements, possibly in different sales outlets. At home, the consumer then has to mark the material, cut out the material or knitwear, insert the reinforcements and attach the fastener elements.

These activities not only require a particular manual skill on the part of the consumer, but also require specific knowledge on cutting out in accordance with a pattern, on the thread course of the various materials and on the stretching properties of knitwear, as well as on the attachment of the fastener elements, such as zip fasteners, buttons, etc. These requirements consequently prevent a lot of consumers from making their own garments, in spite of the saving in costs as compared with read-to-wear products. In addition, the consumer must have suitable equipment and devices, as well as appropriate room at home to enable him to be able to carry out all the steps from the cutting tool out up to the sewing together of the various cut parts without difficulties.

OBJECT OF THE INVENTION

The present invention is directed towards the provision of a variable size key over at least three sizes, a method for making clothing the the consumer himself with a very specific industrially executed sequence chain or said products and garment kit for the self assembly of garments of all types by the consumer for ladies, men and children, which on the one hand, leaves the consumer the cost advantage of complete self production, but on the other hand, does not require either devices, machines or production and material knowledge on the part of the consumer, and permits the consumer to adapt the garment to individual variations of a standard size.

SUMMARY OF THE INVENTION

These aspects of the present invention are set forth in the appended claims.

The recited combination of several interengaging and mutually amplifying product facilities includes the possibility of providing, with a minimum of industrial preproduction (max. 30%), a garment which gives maximum benefit to the consumer and can easily be completed.

The variable component system enables the consumer, even a consumer having a difficult figure not of a standard size in ready-to-wear garments, to make for himself a garment with optimum fit, for example, to compensate, over a range of three sizes, any variations between waist and hip or between chest and waist. In addition, with combination articles (blouses, trousers, skirt, jackets) he can choose different sizes for the upper and lower parts, and order the kits giving him optimum fit advantages.

In practice, the procedure is as follows:

A consumer orders two parts of a combination dress on the basis of the variable measuring tape:

1 jacket, size 38—1 skirt, size 40

(a) she can now make the jacket in the sizes 36–38–40, in accordance with her individual size, since the individual cut parts contain corresponding dimension additions.

(b) the skirt size 40 can be made variable in sizes 38–40–42.

Important: If the body dimensions change, it is possible at any time to take every article apart, and with the additional material present, change the article to a new size.

The crux of the present inventive method is the recognition that the industrial prefabrication is suitable for fabricating the components of a garment which change only slightly over the standard sizes covered and which require, on the one hand, difficult and important working operations, and which also need specific knowledge in material working, and which, therefore, are particularly suitable for industrial prefabrication, in particular automatic production. The proportion of this part of prefabrication is about between 20 and 30 percent, including the cutting to size of the complete ready-to-wear production. The consumer is left to carry out only those activities which do not require any specific experience in making garments and which are restricted essentially to the adaptation to his measurements, the joining together, in particular the sewing together, adhering, welding, pressing, and ironing of the individual garments. Thus, compared with conventional do it yourself tailoring, the consumer saves a number of working operations which, as a rule, require specific skill and training.

A particularly great advantage is obtained by using two or three measurement systems for a corresponding number of standard sizes because, when making the garment, the consumer can take account of his individual measurements which may deviate from standard sizes.

A particular advantage of the present inventive process is that, on the one hand, the consumer saves time and money, without having to dispense with manual activities, for example, as hobby, and that the consumer is provided with preworked, intermediate-worked and finished-worked cut parts with fastener elements and accessories which he can adapt to his individual size and which are made with the necessary skill in production and material industrially, and can therefore be made available at a reasonable cost.

The present inventive process may be summarized substantially as follows:

In accordance with individual sketches of garments, such as coats, trousers, jackets, skirts, blouses or shirts, a collection of women's, men's or children's fashions is developed in matching quality and color styling, and the fabrics suitable for this purpose are defined as regards their color and material themes. From these styling sketches, technical details are then derived and separately drawn, and these details form the pattern for the subsequent cut parts.

From a particular sketch, for example, a basic cut in size 38 is developed which represents the basis for all the other sizes. Thereafter, a so-called "blank" is presewn to enable any defects in making the cut to be corrected in a fitting. Necessary changes are made directly to the basic cut. The cut parts are compared with the cut sketches, and any necessary details or changes may be made.

Now, each model is sewn in the original fabric to ensure that the cut and cloth harmonize in an optimum manner and exactly with the finished part. In this manner, any corrections which may be perceived as being necessary can be finally made to the cut.

All the working operations are cataloged and the sequences defined, separated by working operations in industrial prefabrication and the do-it-yourself work at home. The artist and technical writer subsequently coordinate the drawings and the assembly instructions.

In a parallel sequence with the cut production, the gradation of the other sizes and the combination of several dimension systems into one cut may be carried out, so as to enable a garment article to be offered in all standard sizes. After completing and checking the size sets, the latter may be, for example, stored in a cut copier. In this manner, in accordance with the sizes called up, corresponding layers can be copied out and cut to size on the cutting table. The cut parts are tidied and specific parts are supplied to further working operations. Such working operations may, for example, be the pressing-on of inserts or the preliminary sewing of pocket entries. Small finished parts may also be supplied preassembled, for example, belt loops, motifs, pleats, collars, cuffs, embroidery and slit seams, belts, pockets and waistbands.

All components, including accessories, such as yarn, zip fasteners, buttons and paddings and the respective assembly instructions are finally assembled together in a package ready for distribution in the form of a kit.

A consumer ordering such a package or kit by means of a catalog or choosing it at special distributors, may begin assembly of the components immediately with the aid of the enclosed assembly instructions. To do this, the consumer requires only a minimum of the knowledge which he would have to have had to make garments himself by conventional methods. He also does not require any special devices or special space facilities. Fundamentally, a simple sewing machine is enough, and such a machine is easy to learn to operate.

The present inventive process combines, in a particularly skillful manner, the advantages of industrial production with those of do-it-yourself, with minimum costs and good fit, the consumer's own contribution to the finished product being between 70 and 80 percent. It permits the self production of fashionable garments in a short period of time, with an optimum cost distribution between the industrial prefabrication area on the one hand, and the do-it-yourself area, on the other.

The garment kit defined in the appended claims may, for example, be marketed in foil-like transparent packages. Other known forms of presentation are, however, also conceivable, such as cardboard, bags, rolls, etc.

As is also recited in the appended claims, any appropriate accessories may be included in the packaged garment kit.

A measuring tape to be used for the individual size adaptation is specifically designed so that the consumer can read his standard size and the size in centimeters.

One aspect of the invention resides broadly in a process for the manufacture of garments. The garments are manufactured in a range of sizes, each of the sizes within the range of the sizes having a corresponding plurality of measurements associated therewith, the process comprising the steps of: dividing said range of the sizes into a plurality of subranges of the sizes, the subranges of the sizes being consecutive and, in total, covering the range of the sizes; each of the subranges of the sizes extending over a plurality of the sizes, and at least two of the consecutive subranges of the sizes overlapping such that each of the at least two consecutive overlapping such that each of the at least two consecutive overlapping subranges of the sizes encompass at least one common size; selecting, for each of the subranges of the sizes, at least one of the corresponding plurality of measurements to be common to each of the plurality of sizes over which the each subrange of the sizes extends; and dimensioning a fabric according to the corresponding plurality of measurements.

Another aspect of the invention resides broadly in a process for the manufacture of garments, the garments being manufactured in a limited plurality of sizes, each of the limited plurality of sizes being determined by a corresponding plurality of measurements, the process comprising the steps of: selecting at least one measurement of each of the corresponding plurality of measurements to be common to each of the limited plurality of sizes: and dimensioning a fabric according to the corresponding plurality of measurements of at least one of the sizes, including the common measurement, to produce at least one garment having a size within the plurality of sizes, the produced garment having at least one selected common measurement.

The invention will now be explained in detail, with reference to an example of embodiment illustrated in the drawings, wherein:

BRIEF DESCRIPTION OF THE DRAWINGS

FIGS. 13–28 show various situations in the manual sewing kit final making of pleated waist trousers;

DESCRIPTION OF THE PREFERRED EMBODIMENT

Figure 1:
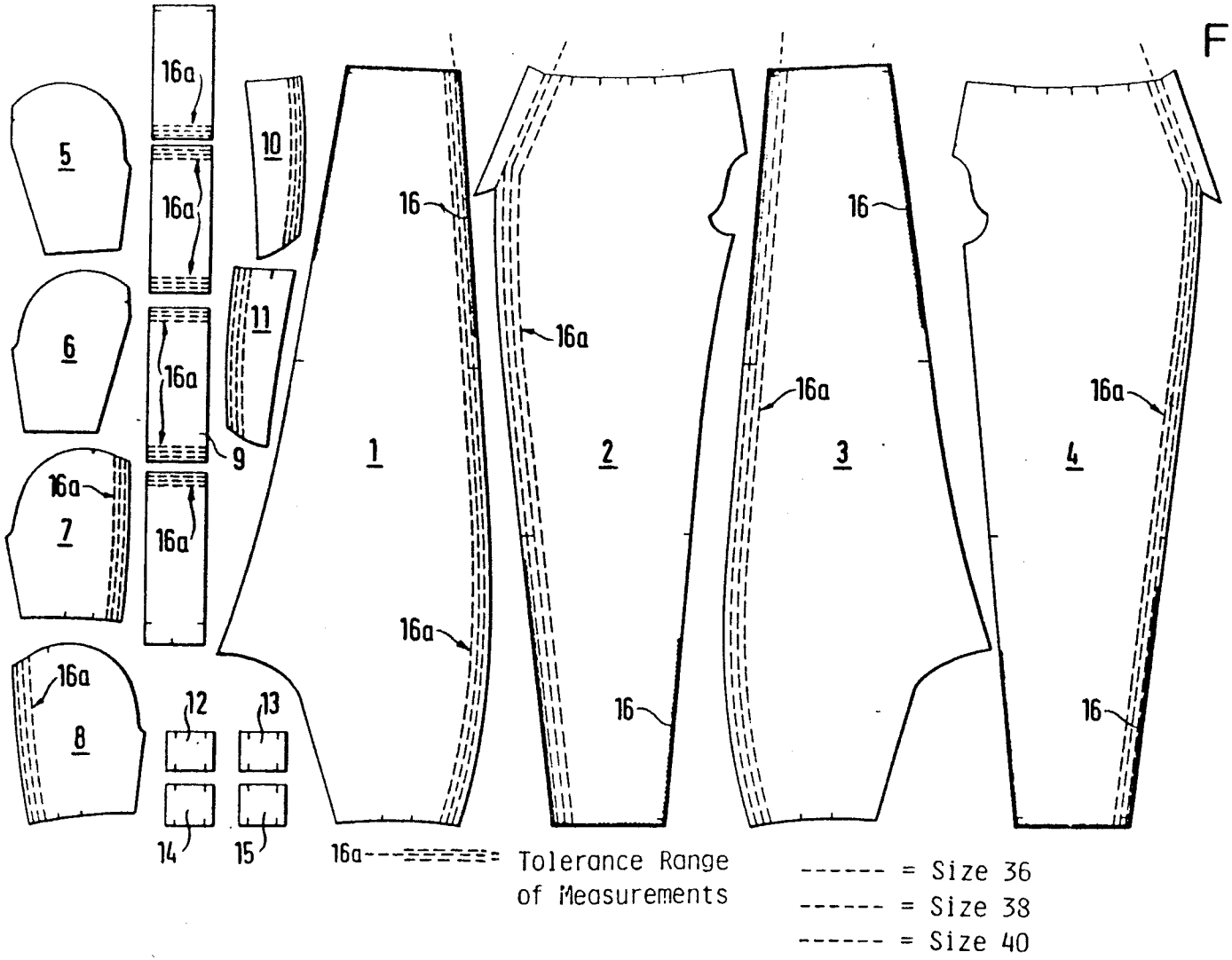
FIG. 1 is a component set for pleated waist trousers without accessories and sewing yarn.

Referring now to the attached drawings, and most particularly to FIG. 1, in an industrially prefabricated garment kit, according to the invention, the two front portions of legs 2, 4 and the two rear portions of legs 1, 3 are provided with peripheral finishing or tidying seams 16. This is a finished part of the purchased product which is completed in a partial manner. Each cut part includes three sizes, the center line of which corresponds to the ideal measurement, for example, of size 38. The inner line corresponds to size 36, and the outer line to size 40. Since the Parts are tidied, it is advisable not to cut off the excess width of the dimension addition 16*a*, but to leave it should any changes in size become necessary.

Figure 4:
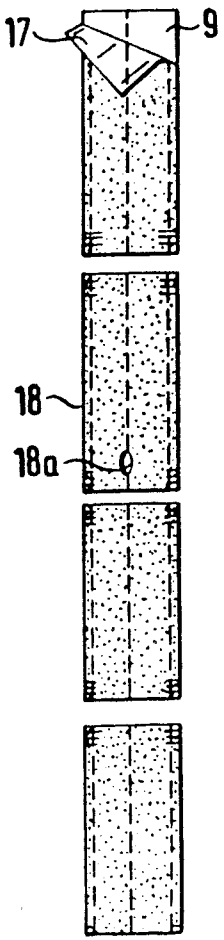
FIGS. 2–12 show different situations of the industrial sewing set prefabrication of pleated waist trousers.

Following this, as is shown most particularly in FIG. 4, the inserts 17 are ironed onto the trouser waistband parts 9. These steps represent finishing of medium scope (intermediate working). The variable waistband makes it possible to prefabricate the button hole 18*a* on the waistband.

Figure 5:
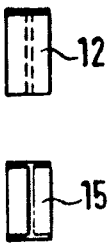

The band loops 12–15 according to FIGS. 1 and 5 are finished by tidying, sewing over, cutting and ironing.

Figure 2:
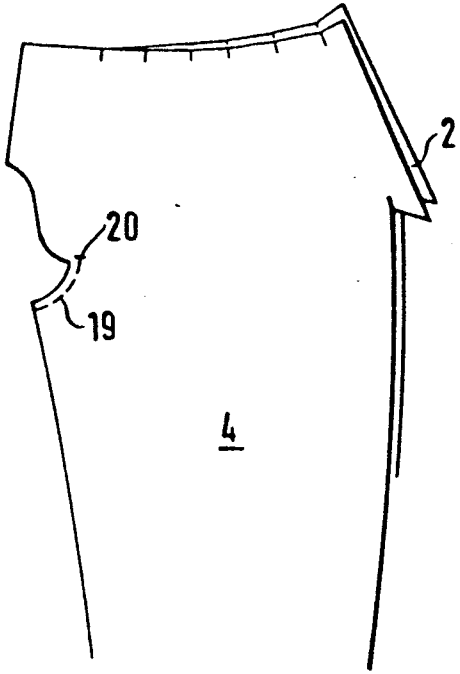

FIG. 2 shows that the two front portions of legs 2, 4 are sewn together at the front center portion 19 up to the snip 20. This is again a finish of smaller scope.

Figure 3:
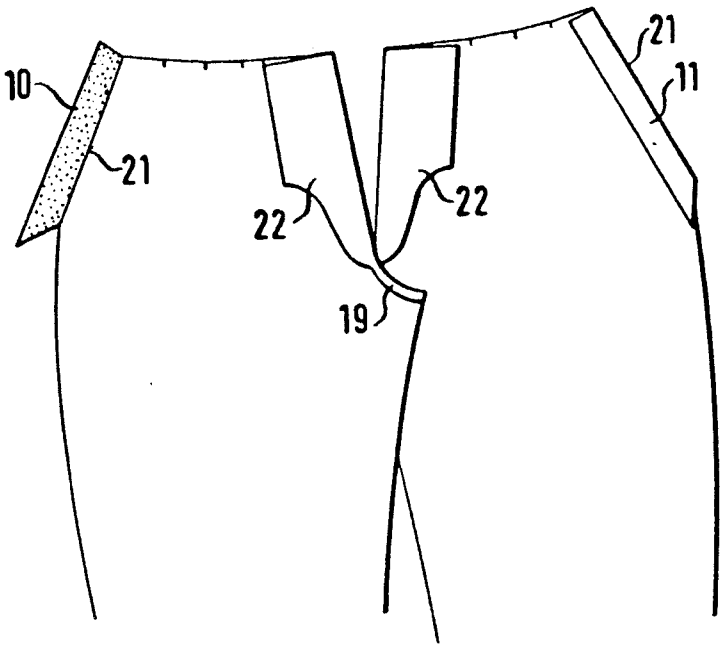

FIG. 3 shows the attachment of the inserts 10, 11 to the pocket entrances 21. Firstly, the inserts 10, 11 are ironed on and then the pocket edges ironed over. It is also apparent from FIG. 3 that the two zip fastener edge borders 22 are ironed over.

Figures 6, 7, 8, 9, 10:
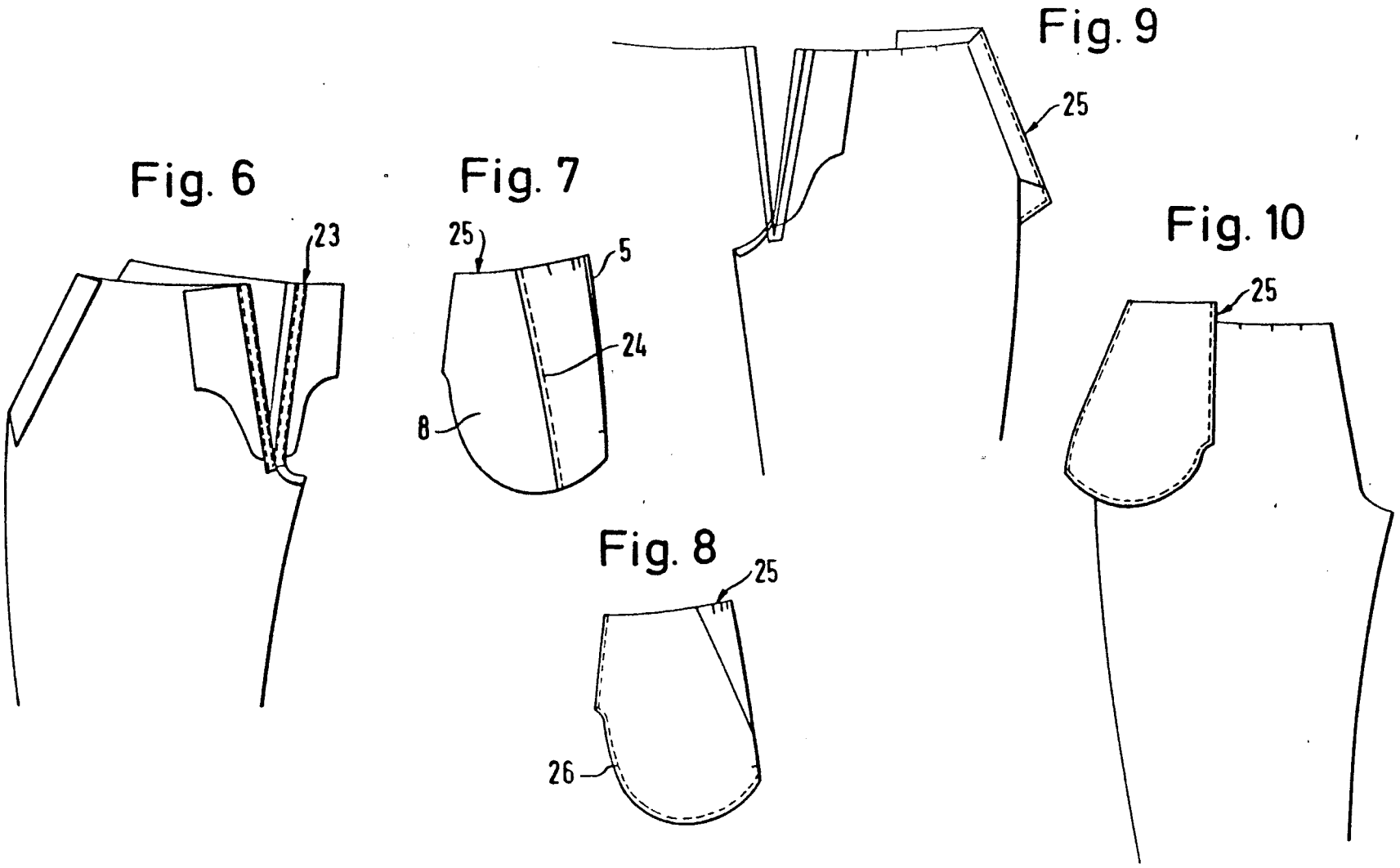

Now, in accordance with FIG. 6, the zip fastener 23 is sewn in with a two-needle machine.

FIG. 7 shows the sewing in of the lower pocket part 5 on a lining pocket part 8 and the chain-stitching 24. A lining pocket part 25 is formed.

Thereafter, in accordance with FIG. 8, both lining pocket parts 25 are placed against each other and closed all round with safety stitch 26.

Figure 11:
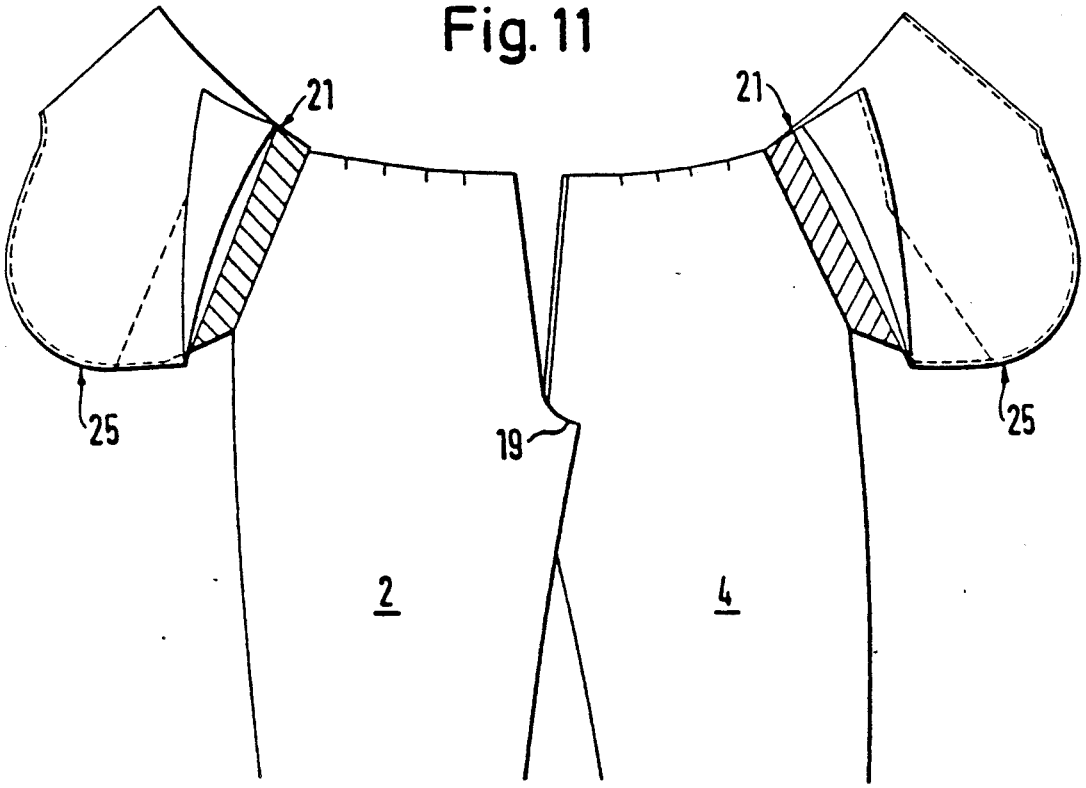
Figure 12:
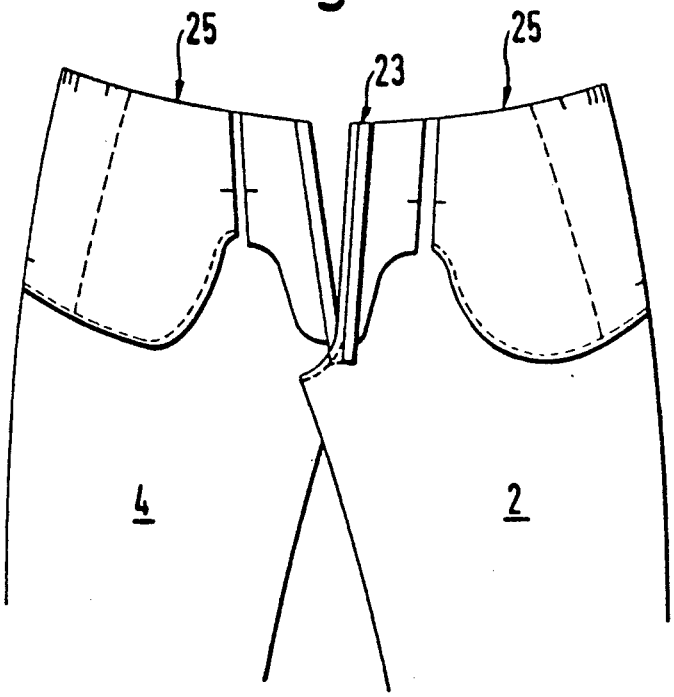

It can then be seen from FIGS. 9–12 that the pocket bags 25 are sewn with safety stitches 26 to the pocket entrance 21. FIG. 11 is a view of the right or outer side of the front portions of legs 2, 4, and FIG. 12 is a view of the wrong or inner side of the front portions of legs 2, 4.

This concludes the industrial prefabrication. This product is made available to the consumer in the form of a kit for do-it-yourself assembly.

After opening the kit package and reading the assembly instructions, the consumer will first determine, with the aid of the measurement table, the corresponding size seam of the variable system in order to obtain his optimum size and fit in the garment to be assembled. Thereafter, in accordance with FIG. 13, the presewn zip fastener 23 (not shown) is provided with two quilted seams 27 and locked by means of a cross seam 28.

Then, the waistband folds 29 are pinned according to markings 30 by means of needles 31, and then the belt loops 12–15 placed between the pleats (FIG. 15). Thereafter, the belt loops 12–15 are secured by means of a seam 32.

In accordance with FIG. 16, the next working operation resides in forming the quilted seams 33 at the upper edge of the pocket entrances 21.

Then, double seams 34 are formed at the connection between the pocket bags 25 and the zip fastener border 22 (FIG. 17).

Four short seams 35 are then made in accordance with FIG. 18 to attach the pocket bags 25, at the waist and at the side, to the front portions of legs 2, 4.

In accordance with FIG. 19, two short seams 36 are then to be formed to sew the belt loops 12–15 to the rear portions of legs 1, 3.

Figure 20:
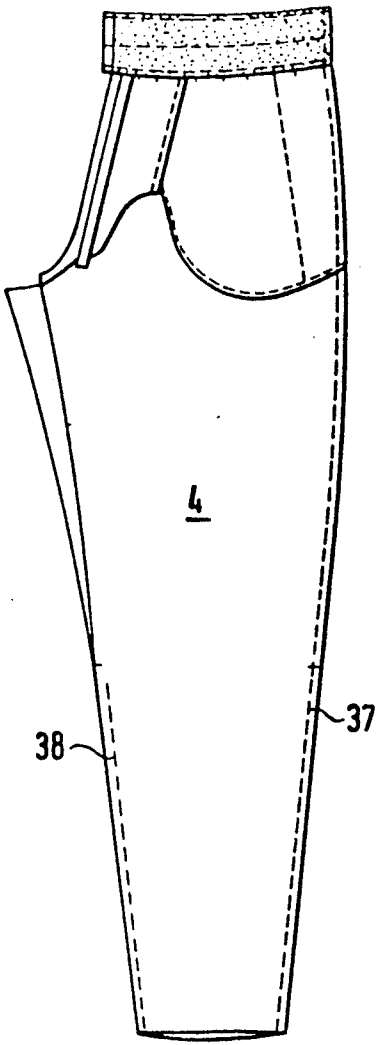

In accordance with FIG. 20, the front portions of legs 2, 4 and rear portions of legs 1, 3 are now sewn together at the sides 37 and in the crotch 38. Short incisions in the material assist here as markings and ensure exactly the matching and placing together of the corresponding parts.

Figure 21:
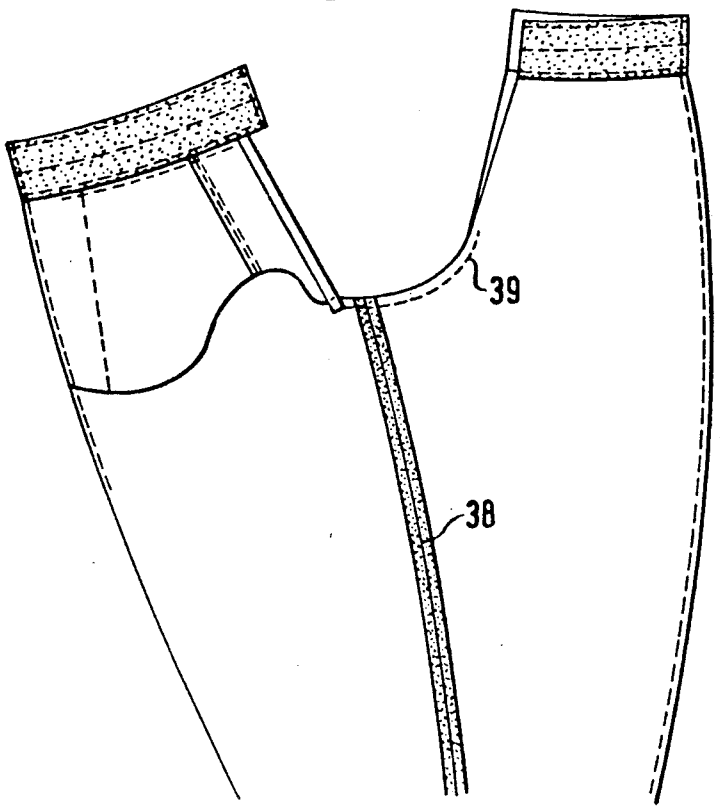

After the sewing together of the front portions of legs 2, 4 and rear portions of legs 1, 3 in accordance with FIG. 21, the seat seam 39 is closed and locked. Thereafter, all the seams so far formed are ironed flat. This is also apparent, for example, from FIG. 21.

In accordance with FIG. 22, the consumer must now form on the trouser waistband 9, two inverted seams at the edges, iron the waistband edges 41 in accordance with the assembly instructions and pleat iron the center 42, as shown in FIG. 23.

Thereafter, the band 9 still open at the lower side 43 is sewn onto the trouser waist seam 44 in accordance with the illustration of FIG. 24. As this is done, two loops 45 are also sewn at the sides.

As is apparent from FIG. 25, the band 9 is then folded up inwardly. Thereafter, the band inner side is pinned and stitched all around from the right side. As is also apparent from FIG. 26, the upper edge 46 of the band 9 is stitched through all around the belt loops being placed over the band 9 in accordance with FIG. 26, and the upper loop edge being tucked in 1 cm and stitched to the band 9.

Thereafter, corresponding to the waist measurements of the consumer, the button 47 is attached to the waistband 9. [See also, in this regard, FIG. 26].

FIGS. 27 and 28 show the sewing inwards of the trouser hem 48 after determining the length measurement.

Figure 29:
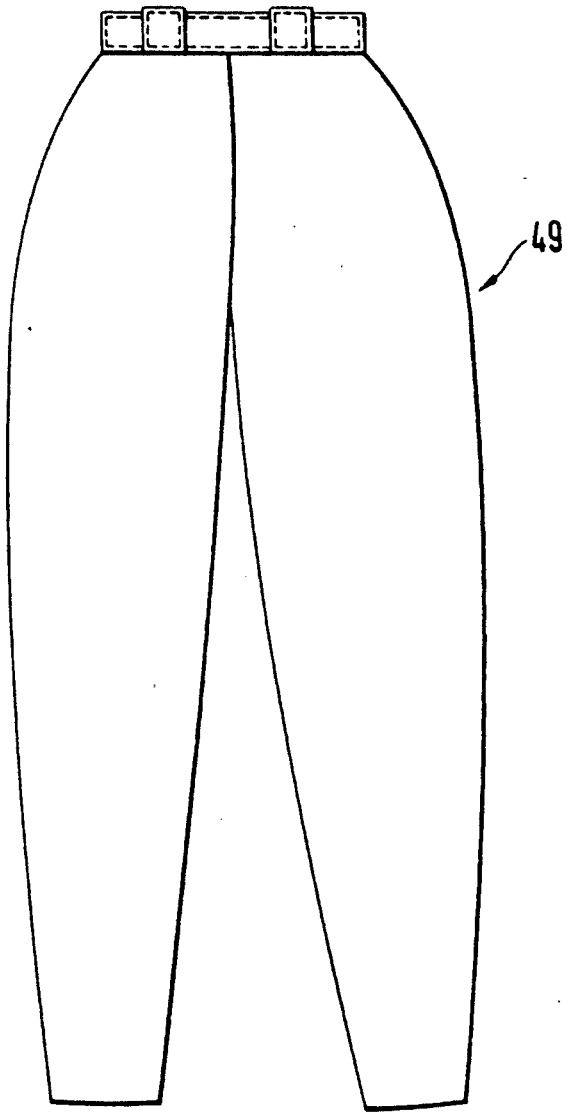
FIG. 29 shows the rear view.
Figure 30:
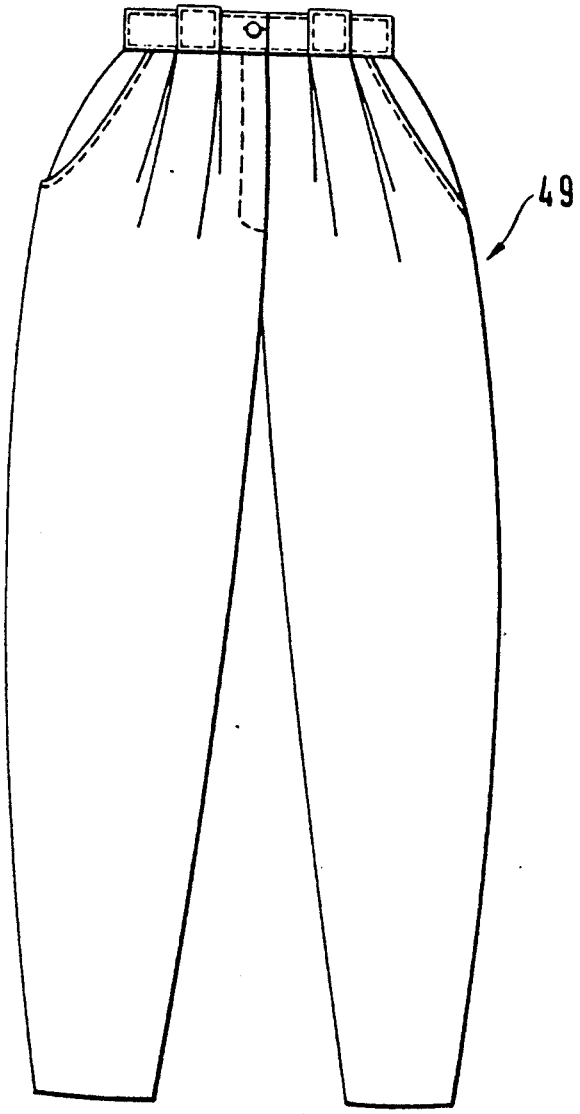
FIG. 30 shows the front view of the finished pleated waist trousers.

The finished trousers 49, as shown in FIGS. 29 and 30, are now turned inside out and all the remaining seams are ironed out. The trousers are then finally pressed from the right side.

The form of the adaptation of the longitudinal seams to the measurements of the consumer explained above applies accordingly also to the adaptation of cross seams and length measurements.

Although the working sequence has been explained above only with reference to trousers, it will be appreciated that an analogous procedure applies accordingly to all other types of garments. Differences arise only as regards the article-specific working sequence.

The present inventor has also discovered a particularly effective and efficient measurement system which may be employed for the production of garment kits, as described above, as well as for the actual production of the fully finished garments themselves by a garment manufacturer. This measurement system is based on the discovery that, of the many measurements used within the garment manufacturing industry to appropriately dimension a fabric into a garment of a so-called "standard size", not all of these many measurements vary significantly over appropriately selected subranges of such standard sizes.

This novel measurement system will be explained with reference to the following Table I, wherein, by way of example, there are listed, for both a First Pattern Unit and a Second Pattern Unit, a number of garment (or "tailoring") measurements according to which these patterns have been dimensioned. (All dimensions shown within Table I are approximate and in cm.)

| | FIRST PATTERN UNIT | | | SECOND PATTERN UNIT | | |
|---|---|---|---|---|---|---|
| Sizes | 36 | 38 | 40 | 38 | 40 | 42 |
| Height | | 168 | | | 168 | |
| | A-measurement | | | | | |
| Chest-Measurement (Circumference) | 84 | 88 | 92 | 88 | 92 | 96 |
| Waist-Measurement (Circumference) | 66 | 70 | 74 | 70 | 74 | 78 |
| Hip-Measurement (Circumference) | 90 | 94 | 98 | 94 | 98 | 102 |
| Armhole Diameter | 9 | 9.5 | 10 | 9.5 | 10 | 10.5 |
| Upper Arm Width (Circumference) | 28 | 29 | 30 | 29 | 30 | 31 |
| | B-measurement | | | | | |
| Neckband (measurement around full neck) | 36.9 | 36.9 | 36.9 | 37.6 | 37.6 | 37.6 |
| Yoke | 6.9 | 6.9 | 6.9 | 7.1 | 7.1 | 7.1 |
| Back Height (e.g., shoulder blade to waist - "Blade") | 19 | 19 | 19 | 19.5 | 19.5 | 19.5 |
| Back Length e.g., Center back (measure from base of neck down, to estimated waist) | 41.4 | 41.4 | 41.4 | 41.6 | 41.6 | 41.6 |
| Hip Depth, e.g., High Hip (measure at top of the hip bones) -circumference | 61 | 61 | 61 | 61.5 | 61.5 | 61.5 |
| Skirt Length (could be variable) | 60 | 60 | 60 | 60 | 60 | 60 |
| Chest Depth, e.g., armpit to center of chest (along breast bone) | 26.9 | 26.9 | 26.9 | 27.6 | 27.6 | 27.6 |
| Waist to Neck | 45.2 | 45.2 | 45.2 | 45.6 | 45.6 | 45.6 |
| Back Width | 17 | 17 | 17 | 17.5 | 17.5 | 17.5 |
| Upper Chest Width, e.g., one half w/o bust | 18 | 18 | 18 | 19 | 19 | 19 |
| Shoulder Width | 12 | 12 | 12 | 12.3 | 12.3 | 12.3 |
| Arm Length | 60.5 | 60.5 | 60.5 | 60.5 | 60.5 | 60.5 |
| Width at Wrist | 16.1 | 16.1 | 16.1 | 16.5 | 16.5 | 16.5 |
| Torso Height | 26 | 26 | 26 | 26.5 | 26.5 | 26.5 |
| Outseam or Side Length | 105 | 105 | 105 | 105 | 105 | 105 |
| Inseam | 79 | 79 | 79 | 78.5 | 78.5 | 78.5 |
| Width Around Hand Knuckles (e.g., Circumference) | 24.5 | 24.5 | 24.5 | 25 | 25 | 25 |

It should first be noted that both the First Pattern Unit and the Second Pattern Unit encompass more than one so-called standard size. That is, the First Pattern Unit encompasses standard sizes 36, 38 and 40, with a nominal size of 38 being the middle of these three sizes. Similarly, the Second Pattern Unit spans the sizes of 38, 40 and 42, with a nominal size 40 being bracketed by the remaining two sizes. It should also be noted that in this preferred embodiment, the height of the garment wearer or purchaser has been taken into consideration. Thus, for illustrative purposes, the wearer or purchaser has been assumed to have a body height of about 168 cm. This is, of course, not necessary for all garments.

Still referring to Table I, it will been seen that for each size (e.g., sizes 36, 38 and 40), within each pattern unit (e.g., the First Pattern Unit), there are associated therewith a corresponding plurality of measurements (e.g., a chest circumference measurement, a waist circumference measurement, a neckband measurement, a yoke measurement, etc.). Such measurements, which are used to determine the various dimensionings of a garment appropriate to a standard sizing arrangement, are well known in the field of garment manufacturing. For example, many of the measurements set forth in Table I are described within one or more of the following publications: *Tailoring-Traditional and Contemporary Techniques,* Ledbetter, et al., Reston Publishing Company, Inc. (1981); *How to Make Men's Clothes,* Rhinehart, Doubleday & Co., Inc. (1975); *The New Vogue Sewing Book,* Butterick Publishing (1980); and *Vogue Fitting,* Lenker, Harper & Row (1984). All of these publications are hereby expressly incorporated by reference, with the same effect as if their entire contents were set forth herein.

The particular measurements set forth in Table I are illustrative, in the sense that they pertain to a preferred embodiment of the present inventive measurement system as applied to the dimensioning of a particular garment kit or furnished garment. Of course, depending upon on the particular garment or garment kit (e.g., jacket, trousers, skirt, etc.) produced according to, or which embodies, the present invention, different pluralities of measurements could be employed.

It should also be noted that within Table I, certain measurements (i.e., the "A-measurement") of the corresponding plurality of measurements for each so-called standard size vary, from standard size to standard size within each pattern unit, while other measurements (i.e., the "B-measurments") remain constant over the range of sizes covered by a particular pattern unit, e.g., the First or Second Pattern Unit. As noted above, the present inventor has discovered that, if the range of total sizes for which garments or garment kits are to be produced according to the present invention is divided into appropriately selected subranges of the total range of sizes, certain dimensioning measurements (i.e., the B-measurements) may be maintained constant within each subrange of sizes, without sacrificing any appreciable degree of proper garment fit. This aspect of the present invention has particular applicability to the manufacture of garment kits which are intended and particularly intended for a final construction and finishing by the purchaser thereof. For example, such a kit may, according to other aspects of the invention set above, have a plurality of seam lines (or similar construction indicia) imprinted directly on the fabric so as to indicate to the purchaser the appropriate construction techniques for forming, from the kit, a number of different size garments. These variable measurements, appropriate for a plurality of different sizes, would correspond to the A-measurements set forth in Table I set forth above. Preferably, they would cover a subrange of standard sizes within the total range of sizes in which the kit could be purchased.

Additionally, the production of such garment kits is considerably simplified by selecting, for each appropriate subrange of sizes, at least one B-measurement which remains substantially constant throughout that subrange of sizes. Thus, certain seamlines (i.e., those corresponding to the B-measurements) could be marked on the fabric at only one location, regardless of the size of garment which may be formed from the kit. Similarly, certain structural details which the kit purchaser might find difficult to construct, for example, buttonholes, appliques, difficult seams, etc., could be prefabricated by the garment kit manufacturer and dimensioned according to a measurement (e.g., a B-measurement) which remains constant for a particular subrange of sizes which the kit covers.

Still further, inasmuch as the manufacture of fully finished garments entails, of necessity, the dimensioning and joining of fabric according to a plurality of corresponding measurements for each size of garment manufactured, it will be appreciated that the present inventive measurement system is seen to have applicability to the manufacture of fully finished or substantially finished garments per se. Thus, a garment manufacturer could considerably simplify his operations by selecting appropriate subranges of sizes and certain relatively invariable corresponding B-measurements to remain constant within particular size subranges.

Finally, and still referring to Table I, it should be noted that, in the preferred embodiment illustrated, consecutive subranges of sizes overlap one another, in the sense that each subrange of sizes encompasses at least one standard size which is common to both it as well as a neighboring subrange. On the one hand, this allows a kit purchaser to make individual adjustments to his or her particular requirements, and also considerably expedites the prefabrication of certain structural details, to the extent that the B-measurements do not vary appreciably within a given pattern unit.

The invention as described hereinabove in the context of the preferred embodiment is not to be taken as limited to all of the provided details thereof, since modifications and variations thereof may be made without departing from the spirit and scope of the invention.

What is claimed is:

1. A process for the manufacture of industrially prefabricated garment kits, the garment kits being for the self-assembly of garments by consumer-wearers, said garment kits for being made in a range of sizes, each of said sizes within said range of said sizes having a corresponding plurality of measurements associated therewith, said process comprising the steps of:

dividing said range of said sizes into a plurality of subranges of said sizes, said subranges of said sizes being consecutive and, in total, covering said range of said sizes;

each of said subranges of said sizes extending over a plurality of said sizes, and at least two of said consecutive subranges of said sizes overlapping such that each of said at least two consecutive overlapping subranges of said sizes encompass at least one common size;

selecting, for each of said subranges of said sizes, at least one of said corresponding plurality of measurements to be common to each of said plurality of sizes over which said each subrange of said sizes extends;

dimensioning a fabric according to said corresponding plurality of measurements of at lest one of said sizes, including said common measurement; and marking the fabric with sizing indicia according to said corresponding plurality of measurements of at least one of said sizes, including said common measurement.

2. The process according to claim 1, wherein each of said plurality of subranges overlaps at least one of said consecutive subranges such that each of said plurality of subranges and at least one of said consecutive subranges encompass at least one common size.

3. The process according to claim 2, wherein each of said plurality of subranges of said sizes consists essentially of three consecutive sizes within said range of said sizes.

4. The process according to claim 1, wherein at least one of said plurality of subranges of said sizes extends over at least three consecutive sizes within said range of said sizes.

5. The process according to claim 1, said process additionally comprising the further step of forming said dimensioned fabric to thereby produce at least one garment having a size within said range of sizes.

6. The process according to claim 1, further comprising the step of fabricating, for each of said subranges of said sizes, a structural garment detail, the location of said fabricated structural garment detail being determined by a dimension which is common to each of said plurality of sizes over which said each subranges of said sizes extends.

7. The process according to claim 6, wherein each of said plurality of subranges of said sizes extends over at least three consecutive sizes within said range of said sizes.

8. The process according to claim 1, wherein said common measurement is a member chosen from the group consisting essentially of: a neckband measurement, a yoke measurement, a blade measurement, a center back measurement, a high hip measurement, a skirt length measurement, a chest depth measurement, a waist-to-neck measurement, a back width measurement, an upper chest measurement, a shoulder width measurement, an arm length measurement, a width-at-wrist measurement, a torso height measurement, an outseam measurement, an inseam measurement, and a knuckle measurement.

9. The process according to claim 8, wherein said plurality of measurements comprises a member chosen from the group consisting essentially of a chest circumferential measurement, a waist circumferential measurement, a hip circumferential measurement, an arm hole depth and an upper arm measurement.

10. A process for the manufacture of industrially prefabricated fabric garment kits, said garment kits being for the self-assembly of garments by consumer-wearers, said garment kits for being manufactured from fabric in a limited plurality of sizes, each of said limited plurality of sizes being determined by a corresponding plurality of measurements, said process comprising the steps of:

selecting at least one measurement of each said corresponding plurality of measurements to be common to each of said limited plurality of sizes;

dimensioning a fabric according to at least one of said corresponding plurality of measurements of at least of said sizes, including said common measurement; and marking said fabric with sizing indicia corresponding to said corresponding plurality of measurements of said limited plurality of sizes, including marking with fabric with said common measurement that is common to each of said limited plurality of sizes.

11. A process according to claim 10, wherein said limited plurality of sizes consists essentially of three sequential sizes.

12. The process according to claim 10, further comprising the step of fabricating, for said limited plurality of sizes, a structural garment detail, the location of said fabricated structural garment detail being determined by a dimension which is common to each of said limited plurality of sizes.

13. The process according to claim 10, wherein said common measurement is a member chosen from the group consisting essentially of: a neckband measurement, a yoke measurement, a blade measurement, a center back measurement, a high hip measurement, a skirt length measurement, a chest depth measurement, a waist-to-neck measurement, a back width measurement, an upper chest measurement, a shoulder width measurement, an arm length measurement, a width-at-wrist measurement, a torso height measurement, an outseam measurement, an inseam measurement, and a knuckle measurement.

14. The process according to claim 13, wherein said limited plurality sizes extends over at least three consecutive sizes within a range of said sizes.

15. A plurality of prefabricated garment kits, said plurality of garment kits being for the self-assembly of garments by consumer-wearers, in a range of sizes, each of said sizes within said range of sizes having a corresponding plurality of measurements associated therewith, each of said plurality of garment kits comprising:

fabric marked thereon sizing indicia for a subrange of said range of sizes, said subrange of said range of sizes comprising a plurality of sizes of said range of sizes, said sizing indicia comprising markings indicated at least some of said corresponding plurality of measurements for each of said plurality of sizes of said subrange of said range of sizes; and at least one common sizing indicia marked on said fabric, said common sizing indicia being common to and substantially the same for each of said plurality of sizes of said subrange of said range of sizes.

16. A plurality of industrially prefabricated garment kits according to claim 15, wherein a first of said plurality of garment kits comprises a first fabric having marked thereon sizing indicia for a first subrange of said range of sizes, and wherein a second of said plurality of garment kits comprises a second fabric having marked thereon sizing indicia for a second subrange of said range of sizes, said first and second subranges of said sizes being overlapping so as to encompass at least one common size.

17. A plurality of industrially prefabricated garment kits according to claim 16, wherein each of said first and second subranges of said sizes extend over at least three consecutive sizes within said range of sizes.

18. A plurality of industrially prefabricated garment kits according to claim 16, wherein each of said first and second garment kits further comprises at least one industrially prefabricated detail, the location of said industrially prefabricated detail on said first fabric being determined by a first dimension which is common to an substantially the same for each of said plurality of sizes in said first subrange of sizes, and the location of said industrially prefabricated detail on said second fabric being determined by a second dimension which is common to and substantially the same for each of said plurality of sizes in said second subrange of sizes.

19. A plurality of industrially prefabricated garment kits according to claim 15, wherein said common sizing indicia comprises at least one of: a neckband measurement, a yoke measurement, a blade measurement, a center back measurement, a high hip measurement, a skirt length measurement, a chest depth measurement, a waist-to-neck measurement, a back width measurement, an upper chest measurement, a shoulder width measurement, an arm length measurement, a width-at-wrist measurement, a torso height measurement, an outseam measurement, an inseam measurement, and a knuckle measurement.

20. A plurality of industrially prefabricated garment kits according to claim 19, wherein said corresponding plurality of measurements comprises at least one of: a chest circumferential measurement, a waist circumferential measurement, a hip circumferential measurement, an arm hole depth and an upper arm measurement.

* * * * *

UNITED STATES PATENT AND TRADEMARK OFFICE

CERTIFICATE OF CORRECTION

PATENT NO. : 4,995,514

DATED : February 26, 1991

INVENTOR(S) : Horst FORSCHNER

It is certified that error appears in the above-identified patent and that said Letters Patent is hereby corrected as shown below:

In column 1, line 57, after 'with', delete "read-to-wear" and insert --ready-to-wear-- in its place.

In column 1, line 60, after 'cutting', delete "tool".

In column 1, line 67, after 'clothing', delete "the" and insert --by-- in its place.

In column 2, line 1, after 'chain', delete "or" and insert --for-- in its place.

In column 2, line 1, after 'and', insert --a--.

In column 5, line 18, after 'the', delete "Parts" and insert --parts-- in its place.

In column 10, Claim 10, line 61, after 'least', insert --one--.

UNITED STATES PATENT AND TRADEMARK OFFICE

CERTIFICATE OF CORRECTION

PATENT NO. : 4,995,514

DATED : February 26, 1991

INVENTOR(S) : Horst FORSCHNER

It is certified that error appears in the above-identified patent and that said Letters Patent is hereby corrected as shown below:

Col. 10, In claim 10, line 67, delete the first instance of "with" and insert --said-- in its place.

Col. 11, In claim 15, line 25, after 'of' insert --industrially--.

Col. 11, In claim 15, lines 10 and 11, after 'markings', delete "indicated" and insert --indicating-- in its place.

Col. 12, In claim 18, line 18, after 'to', delete "an" and insert --and-- in its place.

Signed and Sealed this

Thirteenth Day of October, 1992

*Attest:*

DOUGLAS B. COMER

*Attesting Officer*

*Acting Commissioner of Patents and Trademarks*